US005404790A

United States Patent [19]

Averbukh

[11] Patent Number: 5,404,790

[45] Date of Patent: Apr. 11, 1995

[54] FIREARM WITH GAS OPERATED RECHARGE MECHANISM

[76] Inventor: Moshe Averbukh, Moshav Gilat, Karavan 85, D.N., Hanegev 85410, Israel

[21] Appl. No.: 184,174

[22] Filed: Jan. 21, 1994

[30] Foreign Application Priority Data

Jan. 27, 1993 [IL] Israel ..... 104535

[51] Int. Cl.[6] ..... F41A 5/26

[52] U.S. Cl. ..... 89/193

[58] Field of Search ..... 89/191.01, 193

[56] References Cited

U.S. PATENT DOCUMENTS 2,845,008 7/1958 Atwood ..... 89/193

2,872,851 2/1959 Katz ..... 89/193

FOREIGN PATENT DOCUMENTS 31655 2/1908 Austria ..... 89/193

OTHER PUBLICATIONS

Jan Libourel, "At Last-.44 Magnum Auto Pistol", Guns & Ammo, Oct. 1986, pp. 34–36, 38.

*Primary Examiner*—Stephen C. Bentley

*Attorney, Agent, or Firm*—Mark M. Friedman

[57] ABSTRACT

A firearm with gas operated recharge mechanism, which includes a barrel with internal bore, a slide which is movable with respect to the barrel and which is adapted to operate the components of the firearm as to recharge it. The firearm further includes a cylinder whose interior is connected with the internal bore of the barrel as to receive pressurized gases upon firing and a piston installed in the cylinder and adapted to move rearwardly under the gas pressure as to displace the slide. A return compression spring is associated with the slide. A gas chamber has an inlet and an outlet, the inlet communicating through gas duct with the internal bore of the barrel and the outlet communicating through gas duct with the interior of the cylinder as to connect them.

10 Claims, 3 Drawing Sheets

FIREARM WITH GAS OPERATED RECHARGE MECHANISM

The invention relates to automatic or semiautomatic firearms with gas operated recharge mechanism.

Gas operated recharge mechanisms are used in different types of firearms. For example, the pistol Desert Eagle designed and manufactured by Israel Military Industries is provided with such recharge mechanism. This pistol comprises a barrel with internal bore, a slide axially movable with respect to said barrel, a cylinder the interior of which communicates with said bore through a gas duct, a piston installed in said cylinder and connected with the slide so as to actuate it for firearm recharge. The cylinder interior receives pressurized gases generated during the firing in order to move the piston which operates the slide.

The semiautomatic rifle according to U.S. Pat. No. 3,990,348 has a similar design. In this rifle a relief valve structure is provided which communicates with the interior of the gas cylinder as to relieve excess gas pressure.

The disadvantage of such firearm design is that its three important parameters: target accuracy, slide mass (which is a considerable part of firearm total mass) and recharge time are interdependent so that any attempt to improve one of them leads to deterioration of the others.

The detailed analysis of this dependence can be made with reference to the scheme shown in FIG. 1, wherein are designated; 1-barrel; 2-internal. bore of the barrel; 3-slide; 4-return spring; 5-piston with stem; 6-cylinder; 7-interior of the cylinder; 8-gas duct connecting the internal bore 2 of the barrel with the interior 7 of the cylinder 6; 9-bullet.

The recharge mechanism operates as follows. The high pressure gases created by the explosion of the powder propels the bullet along the barrel bore towards the muzzle end of the barrel. As soon as the bullet has passed the inlet of the gas duct 8, simultaneously with further bullet propelling, the gases from the barrel 1 rush through said gas duct into the interior 7 of the cylinder 6 wherein they begin to move the piston 5 and thereby the slide 3 connected therewith rearwardly against the action of the return spring 4. The slide begins to pick up speed.

To avoid premature barrel opening which can result in gas rushing from the breech side of the barrel, it is predetermined by the design that the first period of the slide's movement ($t_i$) is an idle stroke ($h_o$), and only thereafter the slide begins extracting the fired cartridge and opening of the barrel from the breech end.

The period ($t_i$) of the idle stroke does not exceed the shot time ($t_{sh}$), and that is just the period when energy is acquired by the slide because only then is there gas pressure in the barrel which is applied to the slide. Toward the end of the idle stroke the slide acquires kinetic energy:

$$E_k = mV^2/2 \quad (1)$$

Thereafter the slide 3 moves against the force of the return spring 4 under its own momentum due to said acquired kinetic energy. Toward the end of the slide's stroke (H) said kinetic energy of the slide 3 is transformed into the potential energy of compression of the return spring 4.

$$E_P = cH^2/2 \quad (2),$$

wherein c is the stiffness of the return spring.

It is evident that the kinetic energy of the slide cannot be less than the potential energy of spring compression:

$$E_k \geqq E_P, \text{ i.e., } mV^2 \geqq cH^2 \text{ or:}$$

$$V \geqq H\sqrt{c/m}\,. \quad (3)$$

As it has been already stated, this speed is picked up by the slide on the idle stroke way $h_o$ during the period $t_i$ when the pressure of the explosive gases is exerted upon the piston 5.

Let P be the average gas pressure in the barrel 1 and let S be the cross-sectional area of the piston 5. A little manipulation yields:

$$h_o = (PSt_i^2)/2m \quad (4)$$

or, taking into account (3) and (4):

$$PS \geqq (H\sqrt{cm})/t_i \quad (5)$$

That is to say, the average force acting on the piston 5 during the time $t_i$ cannot be less than is determined by the formula (5).

It is evident from the formula (5) that the average force (PS) acting on the piston 5 must grow in the case of the increase of the slide's stroke H (which equals the cartridge length plus a small spare distance) as well as in the cases of the increase of the stiffness c of the return spring 4 and of the slide mass m. Said average force must grow also if the idle stroke time $t_i$ which depends upon the shot time $t_{sh}$ diminishes.

The recharge time $t_r$ consists of two of two periods $t_{r1}$ and $t_{r2}$:

$$t_r = t_{r1} + t_{r2},$$

wherein $t_{r1}$ is the time of the slide's movement under its own momentum against the force of the return spring 4 until it meets the stop and $t_{r2}$ is the time of the slide's back movement under the action of the return spring.

Taking into consideration that the slide's movement in cooperation with the spring 4 has harmonic character the following expression is true;

$$t_{r1} = t_{r1} + t_{r2} \approx \frac{2\pi\sqrt{m}}{\sqrt{c}} \quad (6)$$

Now, when all the necessary expressions are available, the possibilities of the improvement of mentioned firearm parameters may be analyzed.

To increase the target accuracy it is necessary to decrease the barrel vibration caused by the slide's backward movement during the shot time. Therefore the speed picked up by the slide 3 during the idle stroke must be diminished and thereby the friction force between the moving slide 3 and the barrel 1 may be decreased which will result in desired vibration decrease.

As is evident from (3), the speed V may be decreased either by diminishing of the spring stiffness c or by increase of the slide mass m.

However, the diminishing of the spring stiffness c will cause recharge time increase, see (6), while the increase of the slide mass m results in growth of the total firearm mass. Besides the increase of the slide mass m makes it necessary to increase the average force applied to the slide during the idle stroke time, see (5), and this on one hand leads to piston diameter increase, that is to say to the growth of the dimensions and of the mass of the firearm, and on the other hand said average force increase results in increase of the barrel vibration during the shot which worsens the target accuracy.

Similar contradictions will be observed on attempt to diminish the firearm mass by decreasing the mass of the slide, and such decrease is extremely important for the light weapons made of plastics or of light aluminum alloys wherein the slide mass may account for half of the total weapon's mass.

The same contradictions between the target accuracy and the firearm mass take place on attempt to decrease the recharge time by increasing of the return spring stiffness c. In this case in order to increase the return spring stiffness either the slide mass or the average force acting on the slide must be increased, and it is evident that said average force increase will cause target accuracy deterioration.

SUMMARY OF THE INVENTION

The main object of the present invention is to eliminate said disadvantages in firearms of the above described type and thereby to provide possibilities for firearms' further improvement.

Another object of the invention is to improve the target accuracy of the firearms, to diminish the slide mass and to reduce the recharge time.

Therefore the proposed firearm is provided with a gas chamber which is connected with the barrel bore and with the interior of the gas cylinder by gas ducts. A non-return valve is installed at the inlet of the gas chamber as to prevent the gas flow from the chamber into the barrel, while the cylinder is provided with outwardly directed controllable non-return valve.

The proposed firearm design will now be described with reference to the drawings in which.

Figure 2:
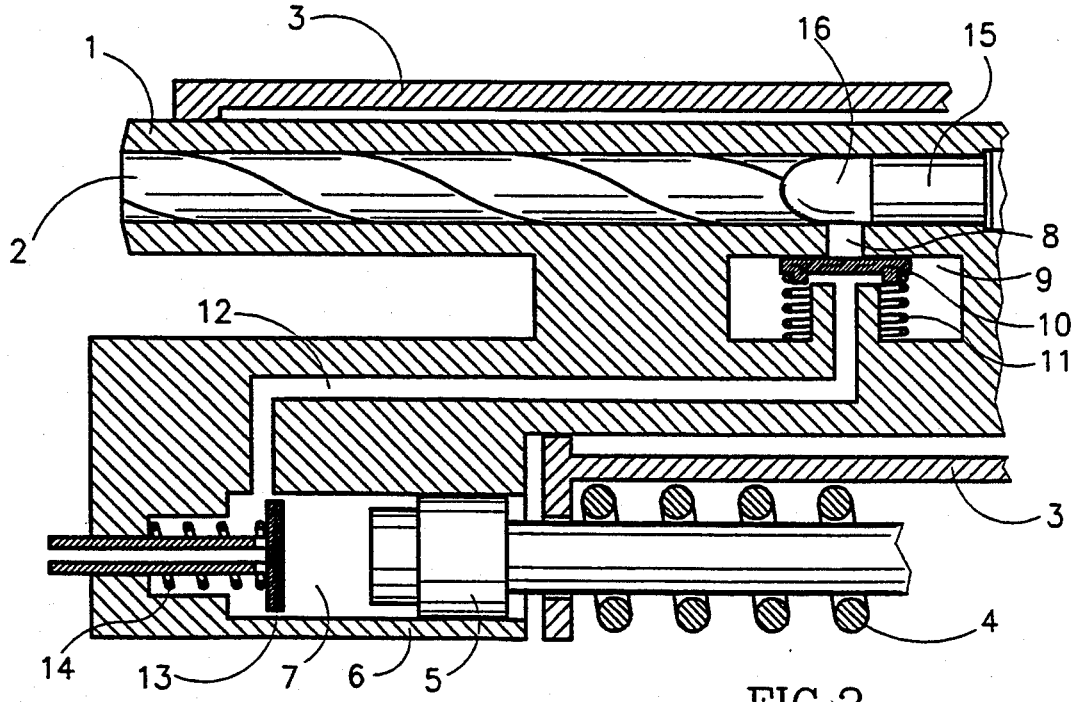
FIG. 2 is a partial sectional view of the proposed firearm.

The firearm according to the invention, see FIG. 2, comprises barrel 1 provided with internal bore 2. The breech end of the barrel 1 is tightly closed by slide 3, which also provides breech opening and firearm recharge, that is to say, extracting and ejecting of the fired cartridge and delivery of a new cartridge from the magazine to the breech of the firearm. The slide 3 is connected with compression return spring 4 which is disposed between the slide and the firearm's body. The return spring 4 tends to return the slide into the normal position in which it tightly closes the breech. The slide 3 is also connected with the piston 5 which is provided with a stem. The piston 5 is installed in the cylinder 6 and adapted to move in cylinder interior 7. The cylinder 6 is rigidly connected with the barrel 1. Gas duct 8 connects the barrel bore 2 with gas chamber 9 which is provided in the firearm's body. Non-return valve 10 is installed in the gas chamber 9 and is normally retained against the outlet of the gas duct 8 by spring 11. The gas chamber 9 is connected with the interior 7 of the cylinder 6 by additional gas duct 12. The inlet of the additional gas duct 12 is disposed under the valve 10 so as to be closed by said valve in the valve's lower position. The cylinder 6 is provided with controllable outwardly directed non-return valve 13 biased by spring 14. Cartridge 15 with bullet 16 is disposed in the breech.

The firearm operates as follows: Pressing the trigger causes powder explosion, thereby high pressure gases are generated which begin to propel the bullet 16 along the barrel bore 2 towards the muzzle end of the barrel. As soon as the bullet 16 has crossed the inlet of the gas duct 8 the gases from the barrel bore 2 rush towards the non-return valve 10 and move it against the force of the spring 11 into lower position providing thereby access into the gas chamber 9. High pressure gases fill the chamber 9 and remain there while the non-return valve 10 is closing the inlet of the additional gas duct 12, that is to say, until the bullet 16 is propelled out of the barrel 1 and the remaining gases escape therefrom. Thereafter, due to the created pressure difference and to action of the spring 11, the valve 10 returns into the initial position, wherein it closes the inlet of the chamber 9, and the gases from the chamber 9 begin to flow into the additional gas duct 12 and therethrough to the cylinder interior 7. Thereby the pressure is applied to the piston 5 which begins to move rearwardly displacing the slide 3 against the force of the spring 4, simultaneously the pressure is applied to the controllable non-return valve 13 retaining it in the closed position. As the non-return valves 10 and 13 in this position are closed, gas cannot return to the barrel and neither can vent through the valve 13. So the gas flow from the chamber 9 to the cylinder interior 7 will last after firing for a period exceeding the shot time and thereby the action of the force applied to the piston 5 and moving said piston and the slide 3 rearwardly is prolonged. On its rearward movement the slide 3 moves out of the cylinder, provides breech opening and ejects the fired cartridge and compresses the return spring 4 which will further return the slide into the initial position. The pressure in the cylinder interior 7 falls and the non-return valve 13 opens.

Returning under spring force into the initial position the slide 3 delivers a new cartridge from the magazine to the breech and tightly closes the breech. As the non-return valve 13 in this position is already open, the piston 5 will easily return into the initial position and close said valve. The firearm is ready for the next shot.

Figure 3:
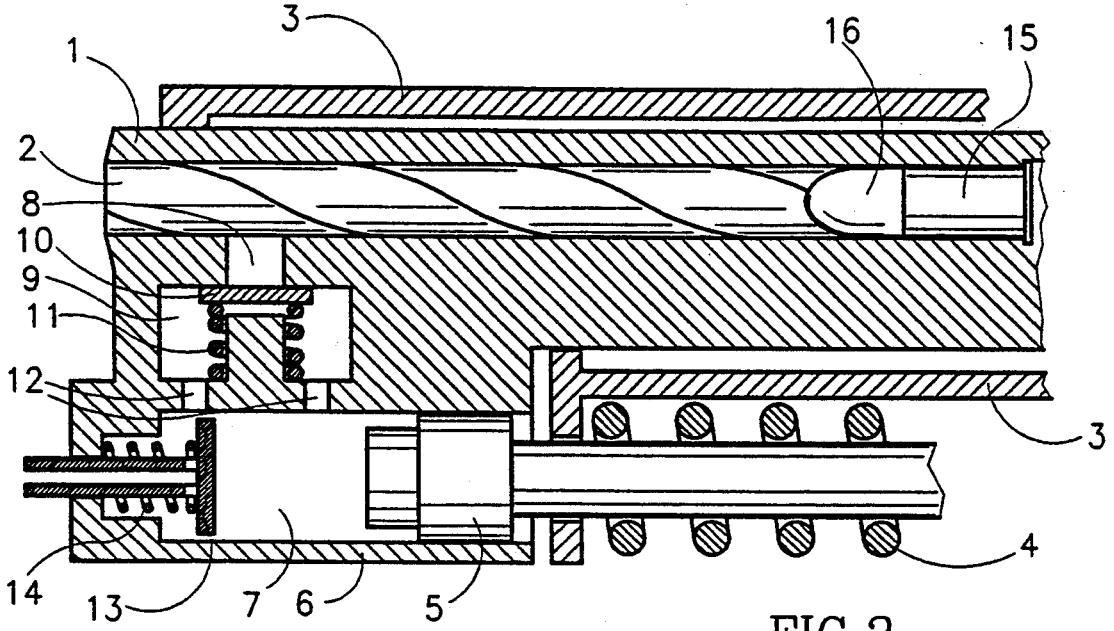
FIG. 3 is a partial sectional view of another embodiment of the proposed firearm.

In another embodiment of the invention, see FIG. 3, the inlet of the additional gas duct 12 is disposed so that the non-return valve 10 cannot close it. In this case the gas flow from the gas chamber 9 through the additional gas duct 12 into the interior 7 of the cylinder 6 will begin immediately after the opening of the non-return valve 10. The gas flow from the gas chamber 9 to the cylinder interior 7 lasts after firing too and the period of the action of the force applied to the piston 5 exceeds the shot time.

Figure 4:
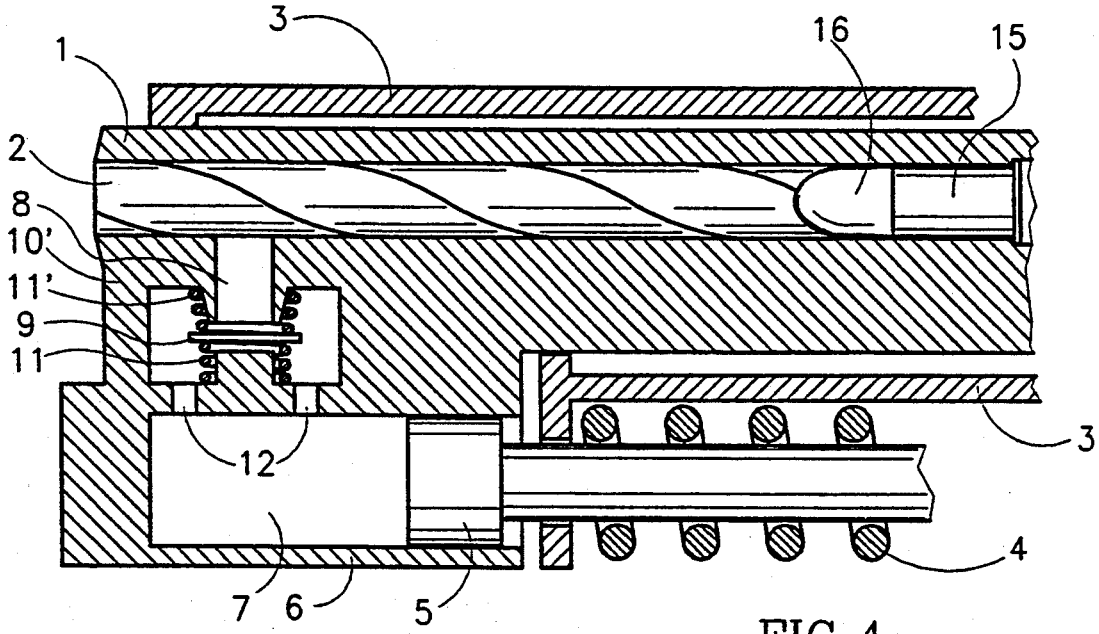
FIG. 4 is a partial sectional view of still another embodiment of the proposed firearm.

In the embodiment of the invention shown in FIG. 4 the valve 10' is equipped with an additional spring 11' which provides a small clearance between the valve and the valve seat in the initial position of the valve before a shot.

As a result, the piston 5 returning to its initial position pushes the gas out of the cylinder 7 through the valve 10' into the evacuated barrel bore 2 and therefrom to the atmosphere, so the non-return valve is not needed.

Figure 5:
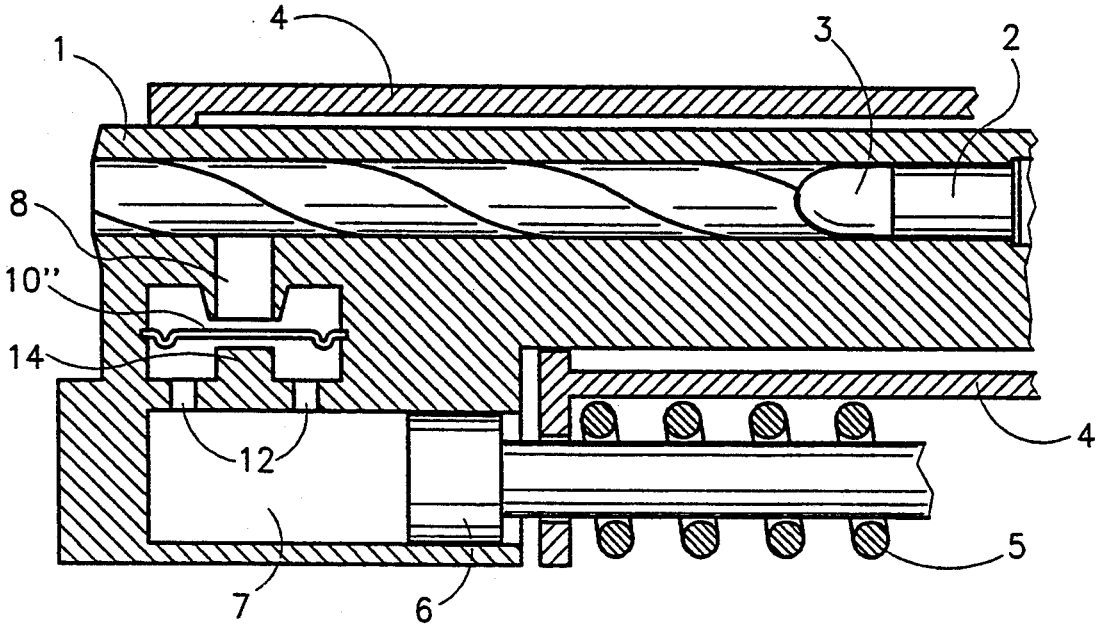
FIG. 5 is a partial sectional view of one more embodiment of the firearm.

In the embodiment shown in FIG. 5 the valve 10'' is made as a resilient element (for example, a membrane) jammed in the walls of the gas chamber 9 and adapted to contact the valve seat.

A small clearance is provided between said resilient element and the valve seat in the initial position. Besides the resilient element is designed so as to allow gas flow between the upper and the lower portions of the gas chamber 9.

In the proposed firearm design the target accuracy is increased due to diminishing of barrel vibration during the shot time, which is caused by following reasons:

in the proposed firearm design the movement of the slide begins either after firing (the first embodiment) or at a moment close to the end of the shot (the second embodiment);

the slide movement is more uniform.

In the proposed firearm design the slide mass and the recharge time can be increased simultaneously.

As is evident from the above description, in the firearm according to the invention the period during which the force is applied to the slide 3 is neither determined by the shot time nor limited by it, so it can be chosen as needed. This considerably decreases the requirements of the kinetic energy acquired by the slide during speed up and thereby the requirements to the slide mass.

The recharge time can be reduced because:

the slide mass decrease results in diminishing the recharge time, see (6);

due to the prolongation of the action of the force applied to the slide, the stiffness of the return spring may be increased (without increasing slide mass) and this will reduce the time of slide's returning to the initial position.

In this way three problems are simultaneously solved: the target accuracy is improved, the firearm mass is diminished and the fire rate is increased.

As an example the calculations comparing the prior art design and for the proposed design are the following.

Figure 1:
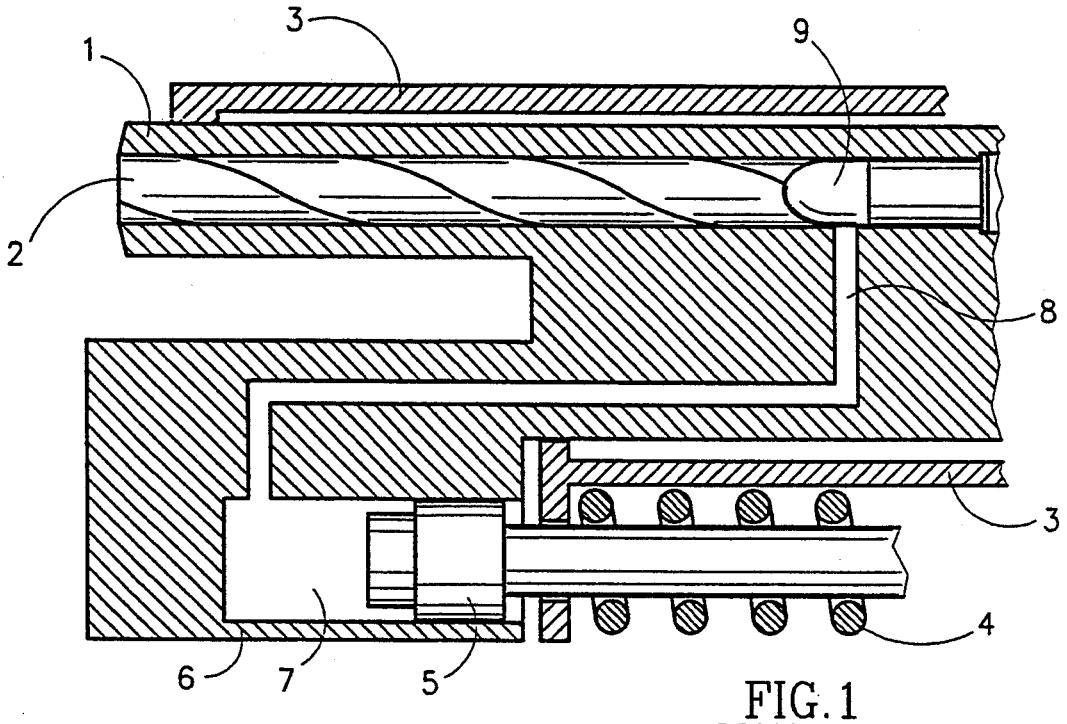
FIG. 1 PRIOR ART
FIG. 1 is a partial sectional view of the firearm of the prior art.

1. The design of prior art, see FIG. 1.

Slide mass m=0.5 kg;

idle stroke of the slide (before breech opening) $h_o=1$ mm;

slide stroke H=50 mm;

return spring stiffness c=10 H/sm;

The average force applied to the slide during the shot:

$$F_{av} \times h_o \geqq cH^2/2$$

$$F_{av} \geqq \frac{cH^2}{2\,ho} = \frac{10 \times 25}{2 \times 0.1} = 1250 \text{ N (125 kg)}$$

The maximum slide speed:

$$V_{max} \geqq H\sqrt{\frac{c}{m}} = 0.05 \times \sqrt{\frac{1000}{0.5}} = 2.2 \text{ m/s}$$

The recharge time:

$$t_r = 2\pi\sqrt{\frac{m}{c}} = 2 \times 3.14\sqrt{\frac{0.5}{1000}} = 0.140 \text{ s}$$

2. The proposed design, see FIGS. 2 and 3.

Slide mass m=0.2 kg;

return spring stiffness c=20 H/sm (twice more than in the firearm of prior art)

The recharge time for the novel design is determined by another formula because the character of the slide's movement in this case differs to some extent from that of prior art: in the novel design the first portion of its spring-associated path (corresponding to spring compression) the slide moves under the action of more or less constantly actuating force. If one assumes that the force is sufficient for return spring compression, then, in accordance with the theory of mechanical oscillations, it can be stated that the slides passes through the first portion of its path during one quarter of the period, and the second portion during one half of the period as usual. Hence, for the new design:

$$t_r = \frac{3}{2}\pi\sqrt{\frac{m}{c}} = \frac{3}{2} \times 3.14\sqrt{\frac{0.2}{2000}} = 0.047 \text{ s}$$

which is almost three times less than in the prior art design.

What is claimed is:

1. A firearm with gas operated recharge mechanism, comprising:

(a) a barrel with internal bore;

(b) a slide movable with respect to said barrel and adapted to operate the components of the firearm as to recharge it;

(c) a cylinder whose interior is connected with said internal bore of the barrel as to receive pressurized gases upon firing;

(d) a piston installed in said cylinder and adapted to move rearwardly under the gas pressure as to displace said slide;

(e) a return compression spring associated with said slide;

(f) a gas chamber having an inlet and an outlet, while said inlet communicates through gas duct with the internal bore of the barrel and said outlet communicates through gas duct with the interior of the cylinder as to connect them, said gas chamber being provided with inlet closing means adapted to open the inlet under the action of pressurized gases from the barrel and to return to the initial position, said inlet closing means being a spring-loaded non-return valve.

2. A firearm according to claim 1, wherein said inlet closing means is adapted to close the gas chamber outlet in the position when the inlet is open.

3. A firearm according to claim 2, wherein said inlet closing means is a spring-loaded non-return valve.

4. A firearm as in claim 3, wherein the cylinder is provided with a controllable relief valve.

5. A firearm as in claim 2, wherein the cylinder is provided with a controllable relief valve.

6. A firearm as in claim 2, wherein said inlet closing means is a resilient element jammed in the walls of said gas chamber.

7. A firearm as in claim 1, wherein the cylinder is provided with a controllable relief valve.

8. A firearm as in claim 1, wherein the cylinder is provided with a controllable relief valve.

9. A firearm as in claim 1, wherein the cylinder is provided with a controllable relief valve.

10. A firearm as in claim 1, wherein said inlet closing means is a resilient element jammed in the walls of said gas chamber.

* * * * *